United States Patent [19]

Lee et al.

[11] Patent Number: 4,762,511

[45] Date of Patent: Aug. 9, 1988

[54] TOY CRASH VEHICLE WITH SKEWABLE FRONT WHEELS

[75] Inventors: Shao-Wei Lee; Kwong-Wai Chow, both of Kowloon, Hong Kong

[73] Assignee: Buddy L Corporation, New York, N.Y.

[21] Appl. No.: 42,968

[22] Filed: Apr. 27, 1987

[51] Int. Cl.[4] ..... A63H 17/02; A63H 17/267; A63H 17/273

[52] U.S. Cl. ..... 446/6; 446/470; 446/469

[58] Field of Search ..... 446/6, 4, 462, 465, 446/466, 469, 470, 471, 431, 435, 437

[56] References Cited

U.S. PATENT DOCUMENTS 3,859,752 1/1975 Morrison et al. ..... 446/6

4,588,386 5/1986 Kennedy et al. ..... 446/6

*Primary Examiner*—Mickey Yu

*Attorney, Agent, or Firm*—Michael Ebert

[57] ABSTRACT

A toy vehicle which upon frontal impact with an obstacle simulates in its appearance the consequences of a car crash. The vehicle has a hollow body mounted on a chassis, which body includes a front hood section provided with a front bumper, an intermediate cab section having a hinged door on either side, and a rear section. The cab and rear sections are secured to the chassis, whereas the front section, which is formed of resilient material, is free of the chassis. The front wheels rotate on short axles whose bearings are pivoted on the chassis so that these wheels in their normal state are parallel to the chassis, and in the crash state are angled with respect thereto, as a result of which the wheels are skewed. Slidable on the chassis is a slide whose front end is secured to the bumper, the slide being maintained by a spring-biased detent in a forward position and being urged by a spring to a retracted position. The front wheel bearings and the hinged doors are operatively linked to the slide so that in its forward position, the front hood section is undeformed, the doors are closed and the front wheels are in their normal state. When, however, the vehicle makes frontal impact, the shock thereof releases the detent, thereby freeing the slide to cause it to be shifted to its retracted position, in the course of which the wheels are caused to assume their skewed state, the doors are outflung and the front hood section is deformed to simulate a crash.

7 Claims, 4 Drawing Sheets

TOY CRASH VEHICLE WITH SKEWABLE FRONT WHEELS

BACKGROUND OF INVENTION

1. Field of Invention

This invention relates generally to motorized toy vehicles, and in particular to a toy "crash" car which upon frontal impact with a wall or other obstruction causes the front wheels to become skewed and in other respects simulates a crash and its consequences, the normal appearance of the car being restored simply by closing the side doors which are outflung in the crash.

2. Status of the Art

Motorized toy vehicles are popular with children, for in play the child can maneuver the car and thereby imitate an adult activity. Play acting sometimes takes a destructive form in that a typical child not only enjoys operating a toy in its intended manner but he also takes a certain delight in wrecking the toy. The dismantling of a toy does not usually reflect misbehavior on the part of the child, but an expression of natural curiosity. Thus a child who takes a mechanical watch apart is not trying to destroy the watch, but is seeking to learn how it works.

Play constitutes the earliest form of education, for by manipulating toys, by playing house, and by pretending to carry out various adult activities, the child acquires basic skills preparatory to more mature activity. And since in the adult world, automobiles sometimes become involved in accidents and may be wrecked, a child playing with a toy car may attempt to simulate a real car crash and deliberately crash his toy vehicle into a wall or other obstruction just to see what happens.

With a conventional toy car, the player cannot have his cake and eat it, for once this car is crashed and badly damaged, it is no longer operable. In order, therefore, to provide a player with a toy car that can be crashed without being permanently disabled, so-called "crash" cars have been developed and marketed. In such cars, some of the components such as doors, headlights and bumpers are loosely mounted so that when the vehicle is run into a wall, these components fall off and thereby simulate a crash.

There are a number of practical drawbacks to a "crash" car of this known type. First, because the components necessary to simulate a crash are loosely mounted on the vehicle, they tend to fall off even when the child plays with the car in an ordinary way.

Second, when the vehicle is crashed, the loosely mounted components may scatter in various directions and the child may not be able to retrieve all of the components. Thus, when the car is reassembled, one or more of the components may be missing, and with continued use even more may be missing, so that it is no longer possible to restore the vehicle to its normal condition. Moreover, the need to reassemble the car after each crash becomes a tedious task and the child may lose interest in the toy.

The Kennedy et al. U.S. Pat. No. 4,588,386 provides a toy vehicle which upon front impact simulates a crash without, however, the loss of any component of the vehicle and without the need to reassemble the vehicle in order to restore it to its normal state. The vehicle disclosed in the Kennedy et al. patent has a chassis, a body thereon defined by a front hood section having a simulated bumper prow, an intermediate cockpit section accommodating a hinged side door, and a rear trunk section having a trunk lid hinged thereon. The intermediate and rear sections are rigid and attached to the chassis, whereas the front section is resilient and free of the chassis. Slidable along the chassis is a sled whose front end is attached to the prow, a coil spring urging the sled to a retracted position in which the front section is deformed to assume a crushed appearance.

The side door and the trunk lid are operatively coupled to the sled so that swinging them from their fully open to their closed positions advances the sled against the spring to an extended position which is held by a spring-biased detent and in which the car has a normal appearance. Impact shock releases the detent which frees the sled to return to its retracted position to impart a crushed appearance to the front, the door and lid then being outflung. By again closing the door and lid, the normal appearance of the car is restored.

In terms of simulating a realistic car crash and its consequences, what is lacking in the structure of the Kennedy et al. patent is the effect of a frontal impact on the front wheels of the car. What often happens in a crash in which the front of the car makes direct impact with a wall or other obstacle is a skewing of the front wheels, particularly if the car is moving at a fairly high speed. But in the Kennedy et al. crash car, the front wheels are mounted for rotation on a common axle, and these wheels are in no way affected by the impact. Also of background interest are the following prior art patents. U.S. Pat. Nos.:

1,363,891; 12/1920; Lovington
1,546,431; 7/1925; Brandt
2,597,094; 5/1952; Gutmann
2,757,482; 8/1956; Brown et al.
2,803,920; 8/1957; Salosky
3,176,429; 4/1965; Brown et al.
3,668,804; 6/1972; Winston
3,859,752; 1/1975; Morrison et al.
3,959,920; 6/1976; Ieda
4,114,312; 9/1978; Hendry
4,295,292; 10/1981; Fitzgerald et al.
4,508,521; 4/1985; Klimpert et al.

SUMMARY OF INVENTION

In view of the foregoing, the main object of this invention is to provide a motorized toy vehicle which upon impact with a wall or other obstruction, causes its front wheels to become skewed and in other respects simulates a crash without, however, the loss of any component of the vehicle and without the need to reassemble the vehicle in order to restore it to its normal condition.

More particularly, an object of the invention is to provide a toy "crash" car of the above type which in the simulated crash condition also imparts a crushed appearance to the front hood section of the car body, the driver's side door being outflung so that the car seems to have been badly damaged.

A significant feature of the invention resides in the fact that the seemingly-damaged car can immediately be restored to its normal undamaged condition simply by closing the side doors.

Still another object of the invention is to provide a crash car having a long effective playing life.

Also an object of the invention is to provide a crash car which is of relatively uncomplicated mechanical design and therefore lends itself to low cost mass production.

Briefly stated, these objects are attained in a toy vehicle which upon frontal impact with an obstacle simulates in its appearance the consequences of a car crash. The vehicle has a hollow body mounted on a chassis, which body includes a front hood section provided with a front bumper, an intermediate cab section having a hinged door on either side, and a rear section. The cab and rear sections are secured to the chassis, whereas the front section, which is formed of resilient material, is free of the chassis. The front wheels rotate on short axles whose bearings are pivoted on the chassis so that these wheels in their normal state are parallel to the chassis, and in the crash state are angled with respect thereto, as a result of which the wheels are skewed. Slidable on the chassis is a slide whose front end is secured to the bumper, the slide being maintained by a spring-biased detent in a forward position and being urged by a spring to a retracted position. The front wheel bearings and the hinged doors are operatively linked to the slide so that in its forward position, the front hood section is undeformed, the doors are closed and the front wheels are in their normal state. When, however, the vehicle makes frontal impact, the shock thereof releases the detent, thereby freeing the slide to cause it to be shifted to its retracted position, in the course of which the wheels are caused to assume their skewed state, the doors are outflung and the front hood section is deformed to simulate a crash.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
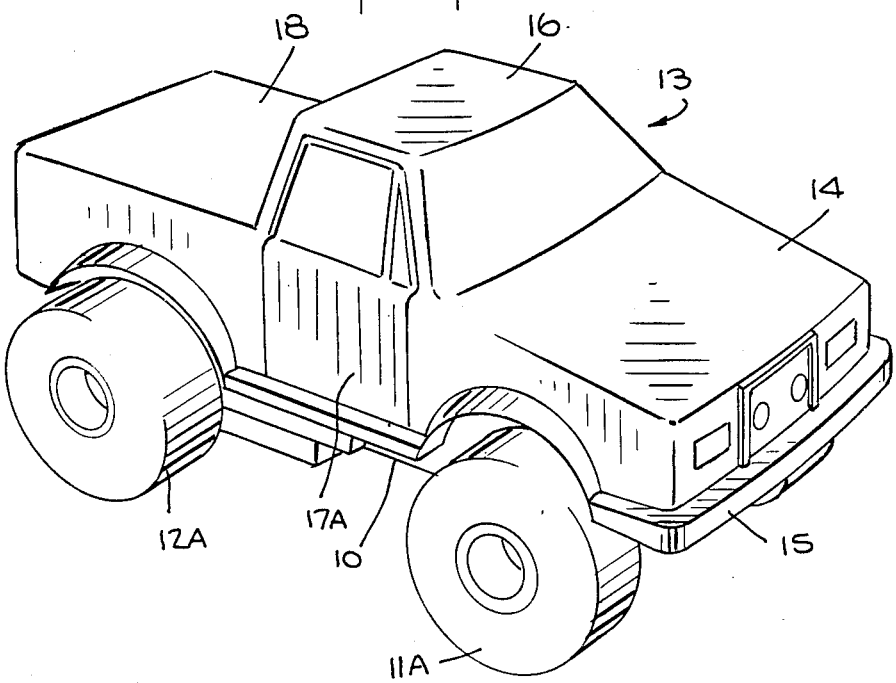
FIG. 1 is a perspective view of a toy vehicle in accordance with the invention, the vehicle being shown in its normal state with the front hood section thereof undeformed, with the front wheels normal to the chassis and with the cab doors closed.
Figure 2:
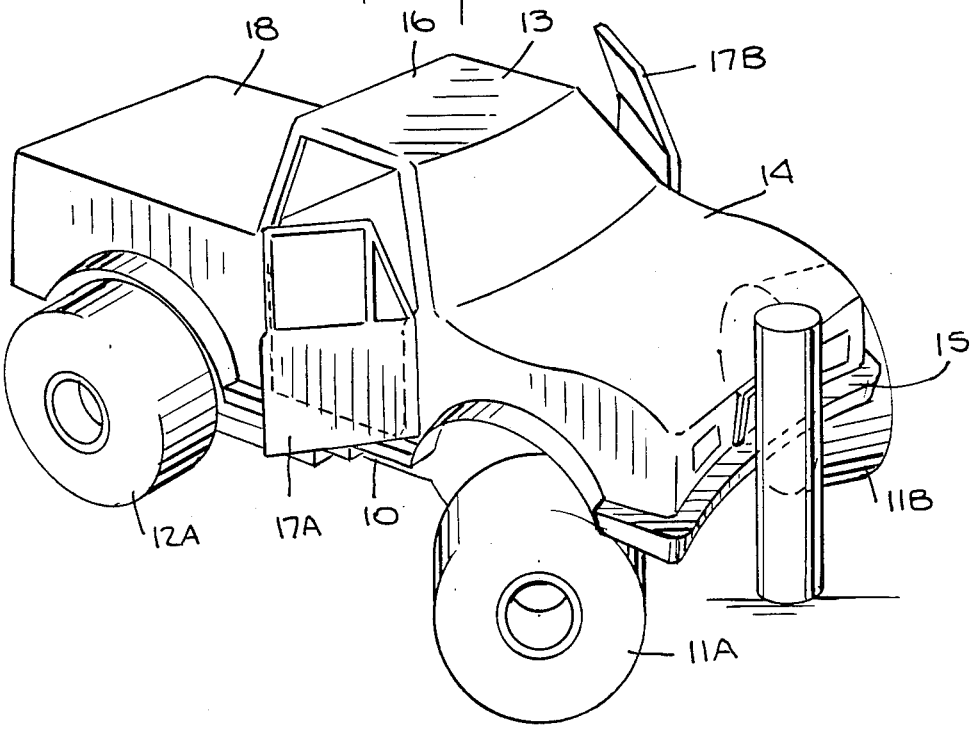
FIG. 2 shows the same vehicle after being subjected to a frontal impact, in which condition the vehicle assumes a "crash" appearance wherein the front hood section is deformed, the front wheels are skewed and the side doors are outflung.

Referring now to FIGS. 1 and 2 which show a preferred embodiment of a "crash" toy in accordance with the invention, it will be seen that the vehicle takes the form of a miniature four-wheeled pick-up truck. It is to be understood, however, that the invention may be embodied in various other vehicular formats and styles, such as a sedan, a station wagon, a coupe or in any other conventional or fanciful form.

Included in the vehicle is a chassis 10 which supports the axle bearings for front wheels 11A and 11B and rear wheels 12A and 12B. Mounted over the chassis is a hollow body, generally identified by reference numeral 13. This body includes a front engine-hood section 14 having a front bumper 15 below the simulated headlights. Front hood section 14 is joined to an intermediate cab section 16 for the driver, this section having on either side thereof hinged doors 17A and 17B. Intermediate section 16 is joined to and integral with a rear pick-up section 18 for carrying a load.

The intermediate and rear sections 16 and 18 of the body are molded of rigid, synthetic plastic material, such as PVC of polyethylene, whereas front section 14 is molded of a resilient plastic material. This resilient material has a memory such that when the front section is pressed in and deformed, it then assumes a crushed appearance; but when the pressure is released, the front section regains its normal shape and appearance.

Thus, in FIG. 1, front section 14 is undeformed and has the usual appearance of an engine hood, whereas in FIG. 2 which illustrates the state of the vehicle when it is subjected to frontal impact against a stationary post 19, then front section 14 and its bumper 15 are deformed, as would happen when a conventional car crashes into a post or other obstacle.

In the normal state of the vehicle, as shown in FIG. 1, not only is front section 14 undeformed, but the front wheels 11A and 11B then occupy their normal parallel positions. In this normal state, side doors 17A and 17B are closed, as would be the case when the vehicle is running. When a crash takes place, then, as shown in FIG. 2, not only is the front section of the body deformed, but front wheels 11A and 11B are caused to assume a skewed position, while doors 17A and 17B are outflung, thereby simulating the consequences of a crash. In the skewed position, the front wheels are angled toward each other.

A significant feature of the invention is that the player can restore the vehicle after a crash to its normal condition simply by closing doors 17A and 17B. Thus, one may repeatedly crash the toy vehicle and restore it after each crash for another play.

Figure 3:
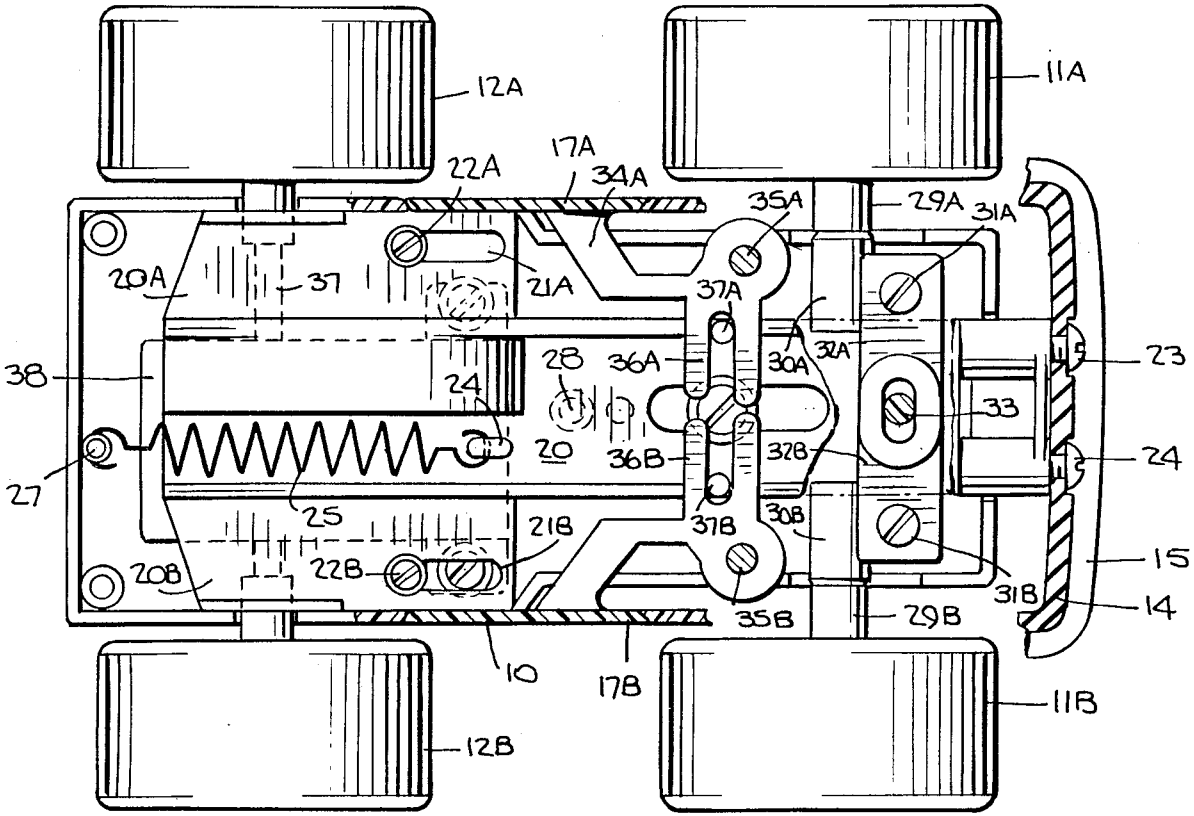
FIG. 3 is a top plan view of the vehicle in its normal state with the box removed to expose the chassis.
Figure 4:
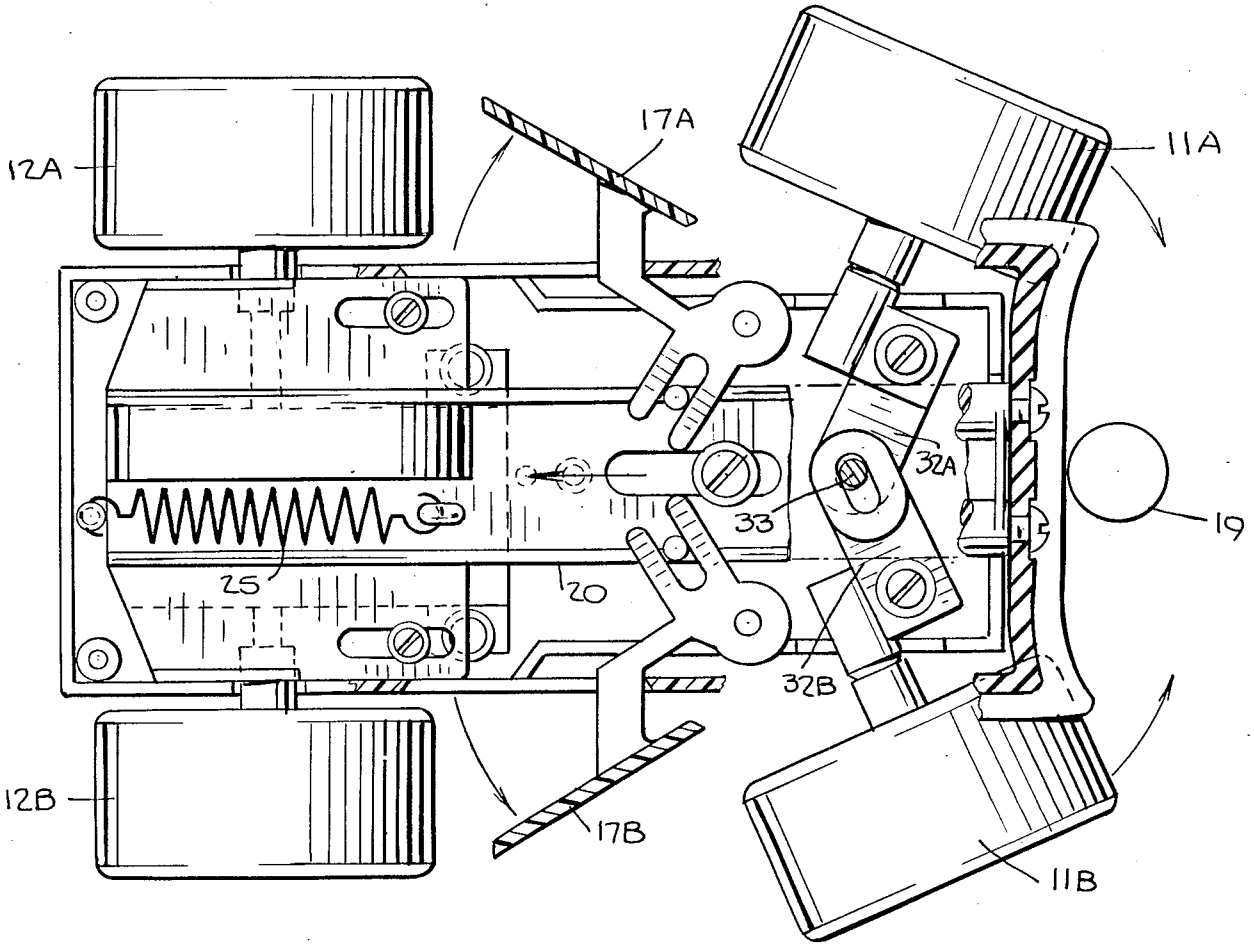
FIG. 4 is the same view as FIG. 3, but with the vehicle in its "crash" state.

As shown in FIGS. 3 and 4, positioned over chassis 10 and shiftable thereon from a forward position, as illustrated in FIG. 3, to a retracted position, as illustrated in FIG. 4, is a channel-shaped slide 20 having at its rear a pair of wings 20A and 20B extending laterally therefrom. Formed in wings 20A and 20B are guide slots 21A and 21B through which limit screws 22A and 22B project which act as stops to define the limits of slide movement.

The front end of slide 20 is secured by screws 23 and 24 to the bumper end 15 of the front section 14 of the vehicle body. The slide is urged from its forward position to its retracted position by a helical spring 25, one end of which is linked to a hook 26 integral with slide 20. The other end of the spring is secured to a pin 27 anchored in chassis 20.

Figure 5:
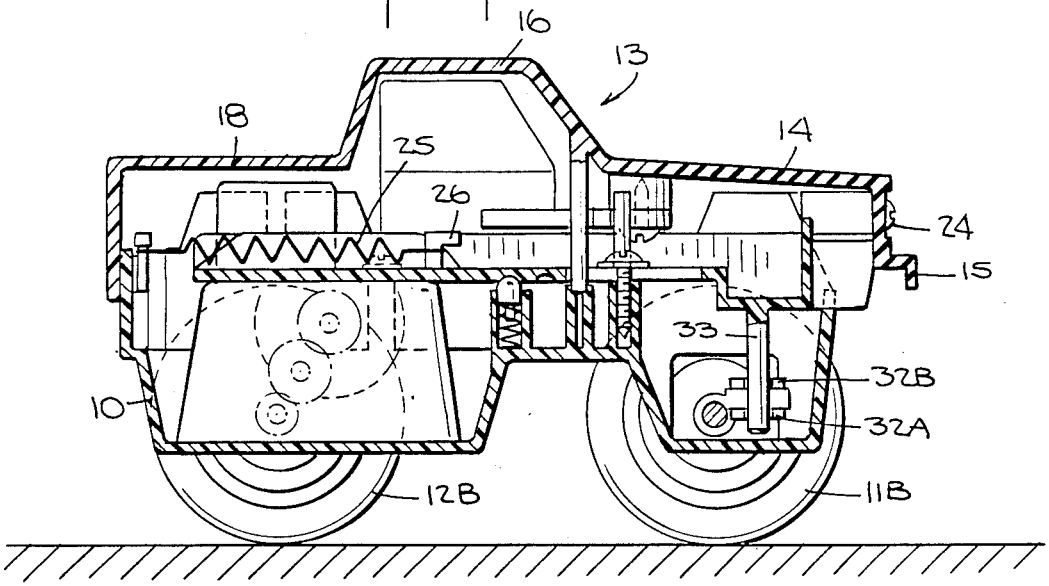
FIG. 5 is a longitudinal section taken through the vehicle in its normal state.
Figure 6:
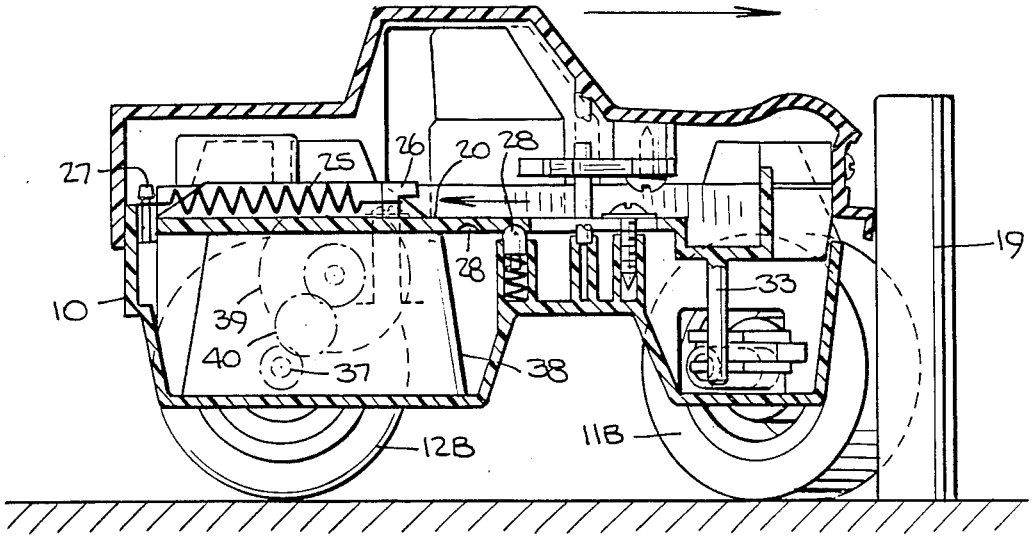
FIG. 6 is the same view as FIG. 5, but with the vehicle in its crash state.

In order to normally maintain slide 20 at its forward position and to prevent the expanded spring 25 from retracting the slide, a spring-biased detent 28 is provided which cooperates with a small cavity 28A on the underside of slide 20, as shown in FIG. 5. However, should the vehicle make a frontal impact with post 19, as shown in FIG. 6, the shock of this impact acts to release detent 28 and permits spring 25 to contract to retract the slide.

Front wheels 11A and 11B, as best seen in FIGS. 3 and 4, are respectively mounted on short axles 29A and 29B. These axles are supported on bearings 30A and 30B that are pivotally mounted on chassis 10 by pivot screws 31A and 31B. Attached to one side of bearings 30A and 30B and extending therefrom are link members 32A and 32B, each having an elongated slot at its free end. Link members 32A and 32B in the normal condition of the vehicle, as shown in FIG. 3, lie in parallel overlapping relation, with the slots therein in registration with each other. Projecting through these slots is a pin 33 secured to the underside of slide 20 (see FIG. 5).

Hence when frontal impact occurs and slide 20 is caused to retract, then this slide pin 33, which engages both link members 32A and 32B, causes the link members, as shown in FIG. 4, to assume opposing angular positions with respect to slide 20. As a consequence, front wheels 11A and 11B are caused to swing inwardly to assume a skewed condition.

As best seen in FIGS. 3 and 4, side doors 17A and 17B are supported by arms 34A and 34B on respective pivot pins 35A and 35B attached to chassis 10, these arms each having an extension fork (36A and 36B). Extending into the space between the two tines of these forks are pins 37A and 37B mounted on chassis 10.

In the normal condition of the vehicle, as shown in FIG. 3, forks 36A and 36B are in colinear relation and are normal to slide 20. But when slide 20 is retracted, as shown in FIG. 4, as a result of a crash, then door arms 34A and 34B are forced to swing in opposite directions, causing doors 17A and 17B to assume an outflung condition. Thus, when a crash takes place, the front wheels 11A and 11B are caused to assume a skewed condition and doors 17A and 17B are at the same time caused to assume an outflung condition.

Rear wheels 12A and 12B are, as shown in FIGS. 3 and 4, mounted for rotation on a common axle 38 which extends through the casing 38 of an inertia motor. This inertia motor is of the type commonly used in toy vehicles. The motor, as shown in FIGS. 5 and 6, includes a flywheel 39 operatively coupled by a gear train 40 to the rear wheel axle 38, so that when the rear wheels turn, this acts to rotate the flywheel.

By repeatedly pushing the vehicle along a running surface in short forward strokes, the player can thereby rev up the flywheel which, because of its inertia, continues to turn. Then when the vehicle is placed on the running surface, the rotating flywheel acts to turn the rear wheel axle to propel the vehicle in the forward direction until the energized motor is exhausted.

To play with the crash car, the player must first close the doors so that the slide is in its forward position and the car assumes a normal appearance. Then the motor is revved up and the car released to run in a direction leading to a wall or other obstruction. Upon frontal impact with the wall, the shock releases the detent and the slide is shifted by spring 25 to its retracted position, this action causing the doors to swing out and the front wheels to become skewed.

In the retracted position of the slide in which the front section 14 of the body has a crushed appearance, the side doors are outflung and the front wheels are skewed, these effects simulating the consequences of a crash. The realistic effects of a crash are further enhanced by the inertia motor; for upon impact with a wall, the motor of the car is still running, and the car, therefore, seeks to climb up the wall and, in doing so, may overturn.

Instead of an inertia motor, one may use a battery-operated motor coupled to the rear wheel axle, the motor being connected to the battery through an inertial switch having a pivoted actuator arm extending from the chassis which can be manually operated to close the switch. At the inner end of this arm is an accelerator mass which seeks to go forward upon impact, thereby shifting the pivoted arm out of contact with a flexible fixed contact that is arranged to engage the arm when the switch is closed. Thus, the motor is disconnected from the battery when the vehicle crashes.

While there has been shown and described a preferred embodiment of a toy crash vehicle with skewable front wheels in accordance with the invention, it will be appreciated that many changes and modifications may be made therein, without, however, departing from the essential spirit thereof. Thus, the bumper may be made independent of the front engine-hood section and attached to the front end of the slide, in which case when the bumper strikes an obstacle, it causes the slide to shift to its retracted position, and in doing so to skew the front wheels and fling out the side doors without, however, affecting or deforming the front section of the body.

We claim:

1. A four-wheeled toy vehicle adapted upon frontal impact with an obstruction to simulate a crash and its effects, said vehicle comprising:

A. a chassis on which are supported the front and rear wheels of the vehicle, each front wheel being mounted on a short axle supported on a bearing pivotally mounted on the chassis to swing in a horizontal plane to permit the bearing of one front wheel to be colinear with the bearing of the other front wheel or to permit these bearings to lie along lines defining an angle in said plane, whereby the front wheels can be made to assume either a parallel state or a state in which the front wheels are skewed relative to each other;

B. a slide shiftable on the chassis from a forward position to a retracted position, the front end of the slide being attached to a bumper which impinges on said obstruction in the event of frontal impact, said slide being maintained in said forward position by a releasable detent, said slide being urged toward the retracted position by a spring; and C. means operatively coupling the pivoted front wheel axle bearings to said slide whereby said front wheels assume their parallel state at the forward position of the slide and are caused to assume said skewed state upon a frontal impact resulting in a shock that releases said detent to cause said slide to shift to its retracted position.

2. A vehicle as set forth in claim 1, further including a body mounted on said chassis, said body having a front hood section that includes said bumper and is formed of resilient material, said front section being joined to a rigid intermediate section of the body, said front section being independent of the chassis, said intermediate cab section being secured to said chassis, whereby when the slide is retracted, the front hood section is deformed.

3. A vehicle as set forth in claim 2, wherein said cab section is provided with hinged side doors which are operatively coupled to the slide so that in the forward position of the slide, the doors are closed, and in the retracted position the doors are outflung.

4. A vehicle as set forth in claim 1, wherein said rear wheels are mounted on an axle, further including a motor mounted on the chassis and operatively coupled to the axle of the rear wheels.

5. A vehicle as set forth in claim 4, wherein said motor is a flywheel motor which is energized when the vehicle is pushed in short forward strokes by the player along a running surface.

6. A vehicle as set forth in claim 1, wherein said means operatively coupling the bearings to the slide are constituted by link members attached to the respective pivoted bearings, the link members having slots therein and lying in parallel overlapping relation when the slide is in its forward position in which condition the slots register and the front wheels are in said parallel state, the slide having a pin mounted thereon which projects through the registered slots, such that when the slide is retracted, the link members then define an angle and the front wheels are in said skewed state.

7. A vehicle as set forth in claim 3, wherein said doors are hinged by arms which are pivoted on the chassis, each arm having a fork extension which is engaged by a pin mounted on the slide so that when the slide is retracted, this causes the door associated with the arm to swing out.

* * * * *